US007950104B2

(12) United States Patent
Yoo

(10) Patent No.: US 7,950,104 B2
(45) Date of Patent: May 31, 2011

(54) VACUUM CLEANER HAVING DUST-SEPARATING APPARATUS WITH SHUTTER UNIT

(75) Inventor: Dong-hun Yoo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 399 days.

(21) Appl. No.: 12/154,581

(22) Filed: May 23, 2008

(65) Prior Publication Data

US 2009/0178233 A1 Jul. 16, 2009

Related U.S. Application Data

(60) Provisional application No. 61/011,344, filed on Jan. 16, 2008.

(30) Foreign Application Priority Data

Mar. 25, 2008 (KR) ..... 10-2008-0027444

(51) Int. Cl.
*A47L 9/10* (2006.01)
*A47L 9/20* (2006.01)

(52) U.S. Cl. ..... 15/347; 15/352; 15/353

(58) Field of Classification Search ..... 15/347, 15/353, 352
See application file for complete search history.

(56) References Cited

U.S. PATENT DOCUMENTS

| | | | | | |
|---|---|---|---|---|---|
| 2,734,595 | A * | 2/1956 | Hurd | 55/367 |
| 5,468,272 | A * | 11/1995 | Schmierer | 55/367 |
| 5,766,283 | A * | 6/1998 | Bumb et al. | 55/367 |
| 6,886,215 | B2 * | 5/2005 | Dodson et al. | 15/339 |
| 2004/0181898 | A1 * | 9/2004 | Kondo | 15/353 |
| 2007/0067945 | A1 * | 3/2007 | Kasper et al. | 15/353 |

FOREIGN PATENT DOCUMENTS

| | | | |
|---|---|---|---|
| DE | EP 067727 0 | A1 * | 10/1995 |
| DE | EP 0677270 | A1 * | 10/1995 |
| EP | 0677270 | | 10/1995 |
| JP | 54085562 | | 7/1979 |
| JP | 54085562 | A * | 7/1979 |
| KR | 10-2005-0106674 | | 11/2005 |
| KR | 10-2006-0018004 | | 2/2006 |

OTHER PUBLICATIONS

Search and Examination Report dated Nov. 18, 2008 corresponding to United Kingdom Patent Application No. 0813249.0.

* cited by examiner

*Primary Examiner* — Bryan R Muller
(74) *Attorney, Agent, or Firm* — Ohlandt, Greeley, Ruggiero & Perle, LLP

(57) ABSTRACT

A vacuum cleaner is disclosed that includes a dust-separating apparatus, a shutter unit, and a dust receptacle. The dust-separating apparatus can be fixed to a cleaner body and includes a dust outlet. The shutter unit is formed on the dust-separating apparatus to selectively open and close the dust outlet. The dust receptacle is detachably attached to a lower portion of the dust-separating apparatus. The dust receptacle opens the shutter unit when attached to the dust-separating apparatus and closes the shutter unit when detached from the dust-separating apparatus.

11 Claims, 6 Drawing Sheets

VACUUM CLEANER HAVING DUST-SEPARATING APPARATUS WITH SHUTTER UNIT

CROSS-REFERENCE TO RELATED APPLICATIONS

This application claims priority from U.S. Provisional Patent Application No. 61/011,344, filed on Jan. 16, 2008, in the United States Patent and Trademark Office, and from Korean Patent Application No. 10-2008-27444, filed on Mar. 25, 2008, in the Korean Intellectual Property Office, the entire disclosure of both of which are incorporated herein by reference.

BACKGROUND OF THE INVENTION

1. Field of the Invention

The present disclosure relates to a vacuum cleaner, and more particularly, to a vacuum cleaner in which removing dust from a dust receptacle is made more convenient.

2. Description of the Related Art

Upright vacuum cleaners generally have a large dust receptacle. A cyclone dust-separating apparatus, which generates a whirling air current is fixed in a cleaner body, and a dust receptacle for collecting dust separated from air by the centrifugal force is detachably attached to the fixed cyclone dust-separating apparatus. When dust has been collected inside the dust receptacle, a user may detach the dust receptacle from the cyclone dust-separating apparatus and empty the dust receptacle.

When the dust receptacle is detached from the cyclone dust-separating apparatus, remaining contaminants may leak out into the cyclone dust-separating apparatus. For example, hair or fibrous material may be tangled near the exhaust grill of the cyclone dust-separating apparatus. If a small impact is applied to the dust receptacle, dust attached to the hairs or the like is scattered around the vacuum cleaner.

The vacuum cleaner or the area around the cleaner body may become dirty when the user empties the dust receptacle, and the user's hands may also be made dirty by the dust. Accordingly, improvements to the dust receptacle are required.

SUMMARY OF THE INVENTION

Exemplary embodiments of the present disclosure address at least the above problems and/or disadvantages and other disadvantages not described above. Also, the present disclosure is not required to overcome the disadvantages described above, and an exemplary embodiment of the present disclosure may not overcome any of the problems described above.

The present disclosure provides an improved vacuum cleaner, in which dust remaining in a dust-separating apparatus is not scattered around the vacuum cleaner even when a dust receptacle is detached from a cleaner body.

According to an exemplary aspect of the present disclosure, there is provided a vacuum cleaner, including a dust-separating apparatus to be fixed to a cleaner body, and having a dust outlet; a shutter unit formed on the dust-separating apparatus to selectively open and close the dust outlet; and a dust receptacle to be detachably attached to a lower portion of the dust-separating apparatus, wherein the dust receptacle opens the shutter unit when the dust receptacle is attached to the dust-separating apparatus, and closes the shutter unit when the dust receptacle is detached from the dust-separating apparatus.

The shutter unit may include a shutter plate to open the dust outlet; a link plate; wherein one end is hinged with the shutter plate, and an opposite end is slidably connected to a sliding slot formed on a lower surface of the dust-separating apparatus, a blocking part on an upper side of the dust receptacle to block the link plate; and an elastic member to elastically support the link plate, and to close the shutter plate by rotating the link plate if the blocking part releases the link plate from interfering.

The link plate may include an interference protrusion disposed opposite the blocking part on a lower surface of the dust receptacle.

The blocking part may include a push protrusion protruding from a portion of the dust receptacle opposite the interference protrusion; and a supporting surface to support the interference protrusion so as to restrict the link plate from rotating.

The receptacle may include a dust inlet to correspond to the dust outlet; and a sliding shutter to selectively close the dust inlet.

The blocking part may be formed on the sliding shutter.

The dust-separating apparatus may be disposed so that the whirling air current rotates about a vertical axis.

An air inlet and an air outlet may be formed on one end of the dust-separating apparatus, and the dust outlet is formed on a bottom surface of the other end of the dust-separating apparatus.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION OF THE INVENTION

Figure 1:
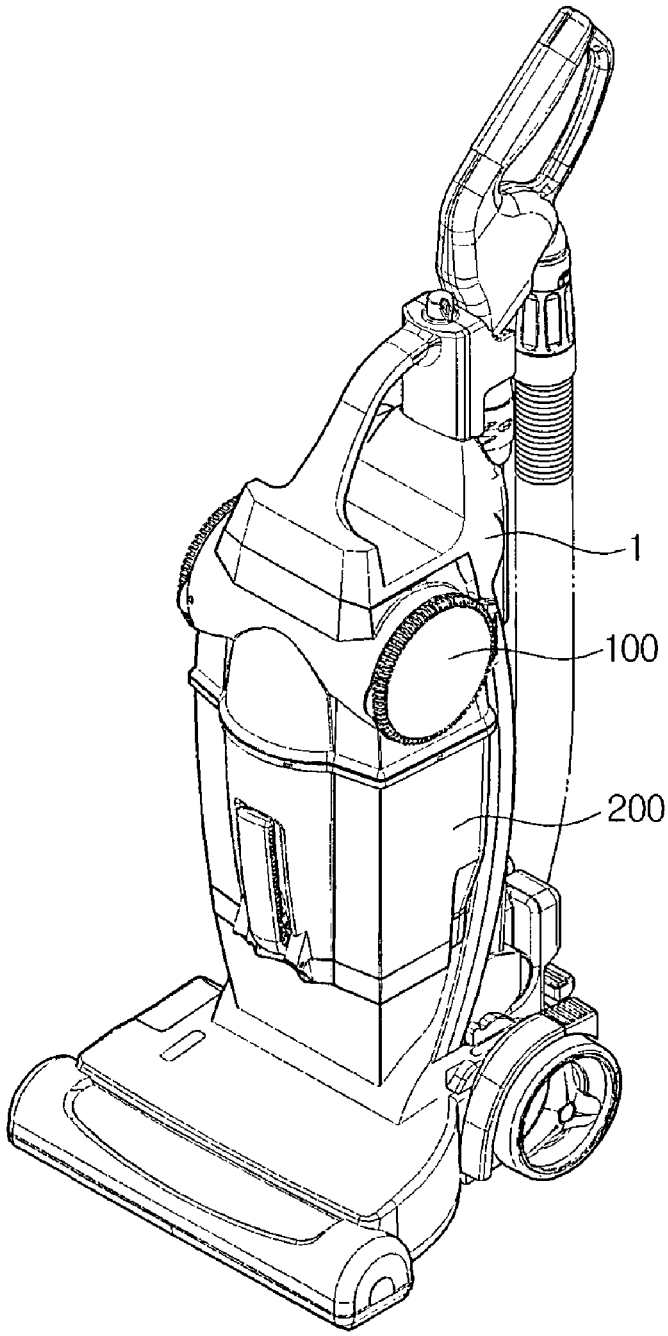
FIG. 1 is a perspective view of a vacuum cleaner according to an exemplary embodiment of the present disclosure.

Certain exemplary embodiments of the present disclosure will now be described in greater detail with reference to the accompanying drawings.

In the following description, the same drawing reference numerals are used for the same elements even in different drawings. The matters defined in the description, such as detailed construction and elements, are provided to assist in a comprehensive understanding of the disclosure. Thus, it is apparent that the present disclosure can be carried out without those specifically defined matters. Also, well-known functions or constructions are not described in detail since they would obscure the disclosure with unnecessary detail.

Figure 2:
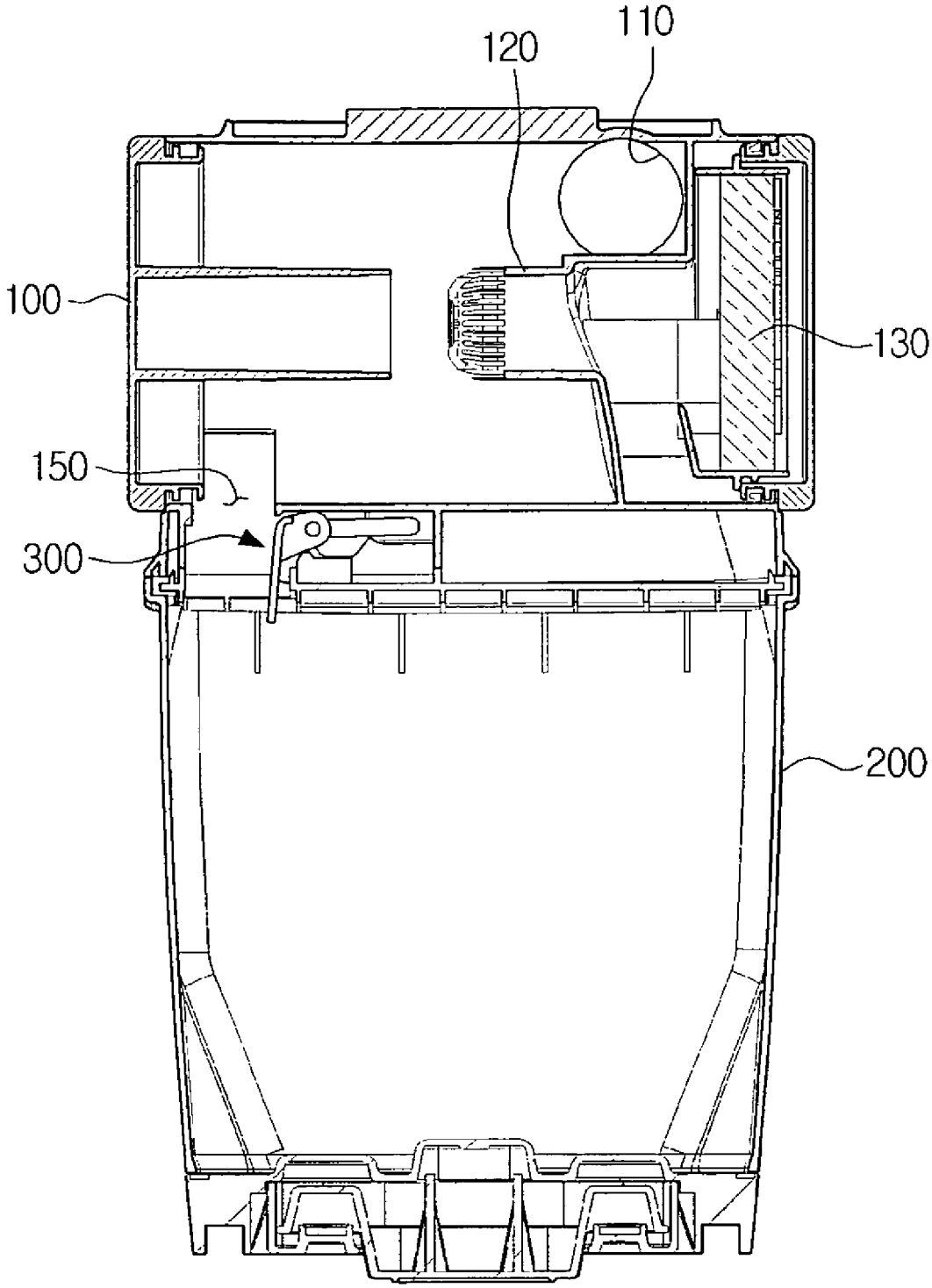
FIG. 2 is a front sectional view illustrating a dust-separating apparatus of the vacuum cleaner of FIG. 1.

FIG. 1 is a perspective view of a vacuum cleaner according to an exemplary embodiment of the present disclosure having a dust-separating apparatus 100 as shown in FIG. 2. The vacuum cleaner may include a cleaner body 1, a dust-separating apparatus 100, a dust receptacle 200, and a shutter unit 300 (FIG. 2). The dust-separating apparatus 100 is fixedly housed in the cleaner body 1, and the dust receptacle 200 is detachably attached under the dust-separating apparatus 100. The shutter unit 300 is disposed on the bottom surface of the dust-separating apparatus 100, and opens and closes according to whether the dust receptacle 200 is mounted or not.

The dust-separating apparatus 100 may be disposed as shown in FIG. 2, so that the whirling air current may rotate around a vertical axis. Specifically, an air inlet 110 is formed on the upper side, and an air outlet (not shown) is formed beneath the air inlet 110. The dust-laden air may be filtered secondarily by a grill pipe 120 having a plurality of air holes and an exhaust filter 130 in order to prevent the dust-laden air from flowing back out through the air outlet. The dust separated by the whirling air current in the dust-separating apparatus 100 is collected in the dust receptacle 200 through a dust outlet 150 which is formed on the bottom surface of the dust-separating apparatus 100.

Figure 3:
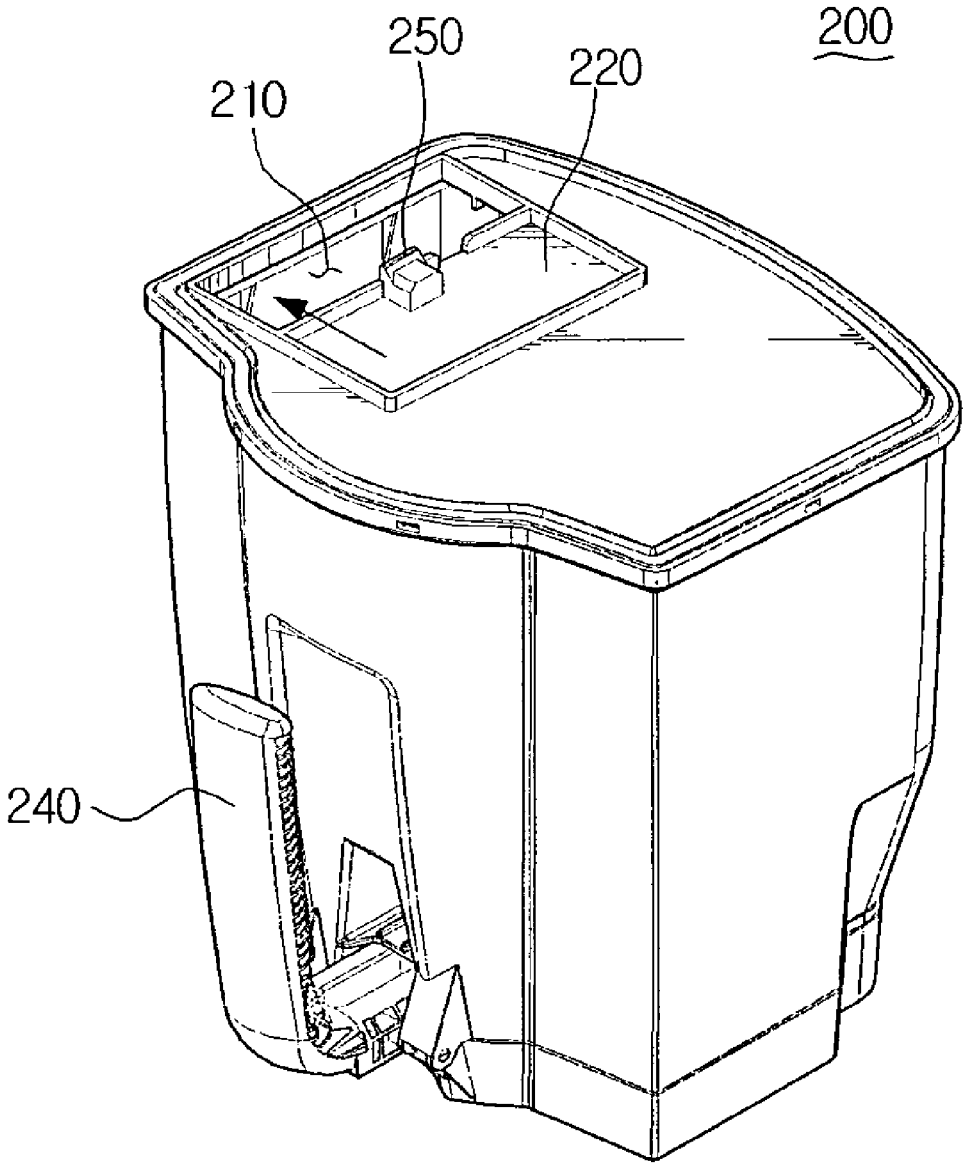
FIG. 3 is a view illustrating a dust receptacle which is mounted to a lower surface of the dust-separating apparatus of the vacuum cleaner of FIG. 1.

As shown in FIG. 3, the dust receptacle 200 includes a dust inlet 210 and a sliding door 220 on an upper side. The size of the dust inlet 210 corresponds to that of the dust outlet 150, and the dust inlet 210 is disposed opposite the dust outlet 150. The sliding door 220 can selectively close the dust inlet 210. A handle 240 protrudes from a front surface, and a user may grasp the handle 240 in order to carry the dust receptacle 200. A blocking part 250 may be formed on the upper surface of the dust receptacle 200 to selectively open and shut the shutter unit 300 according to whether the dust receptacle 200 is mounted. The blocking part 250 will be explained when the shutter unit 300 is described.

Figure 4:
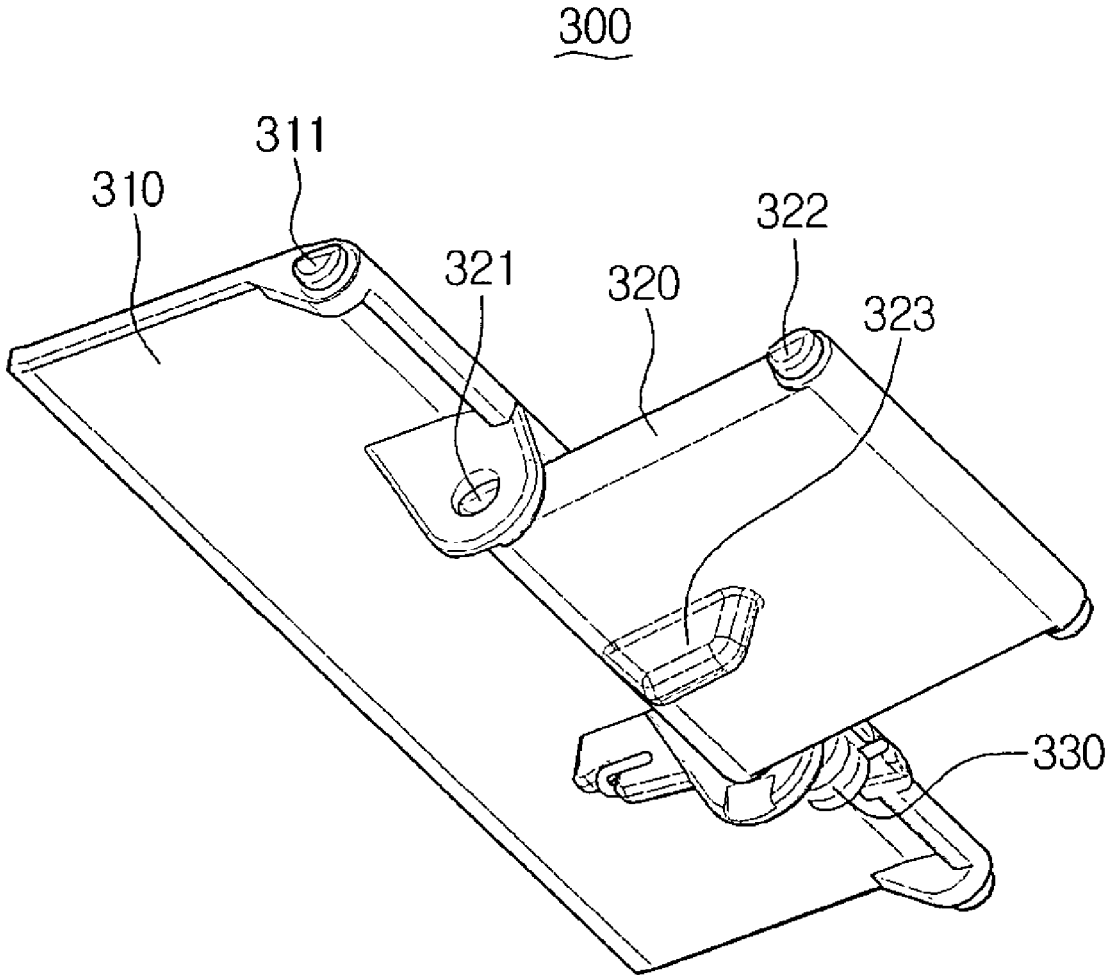
FIG. 4 is a view illustrating a shutter unit which closes an outlet of a dust-separating apparatus according to an exemplary embodiment of the present disclosure.
Figure 5:
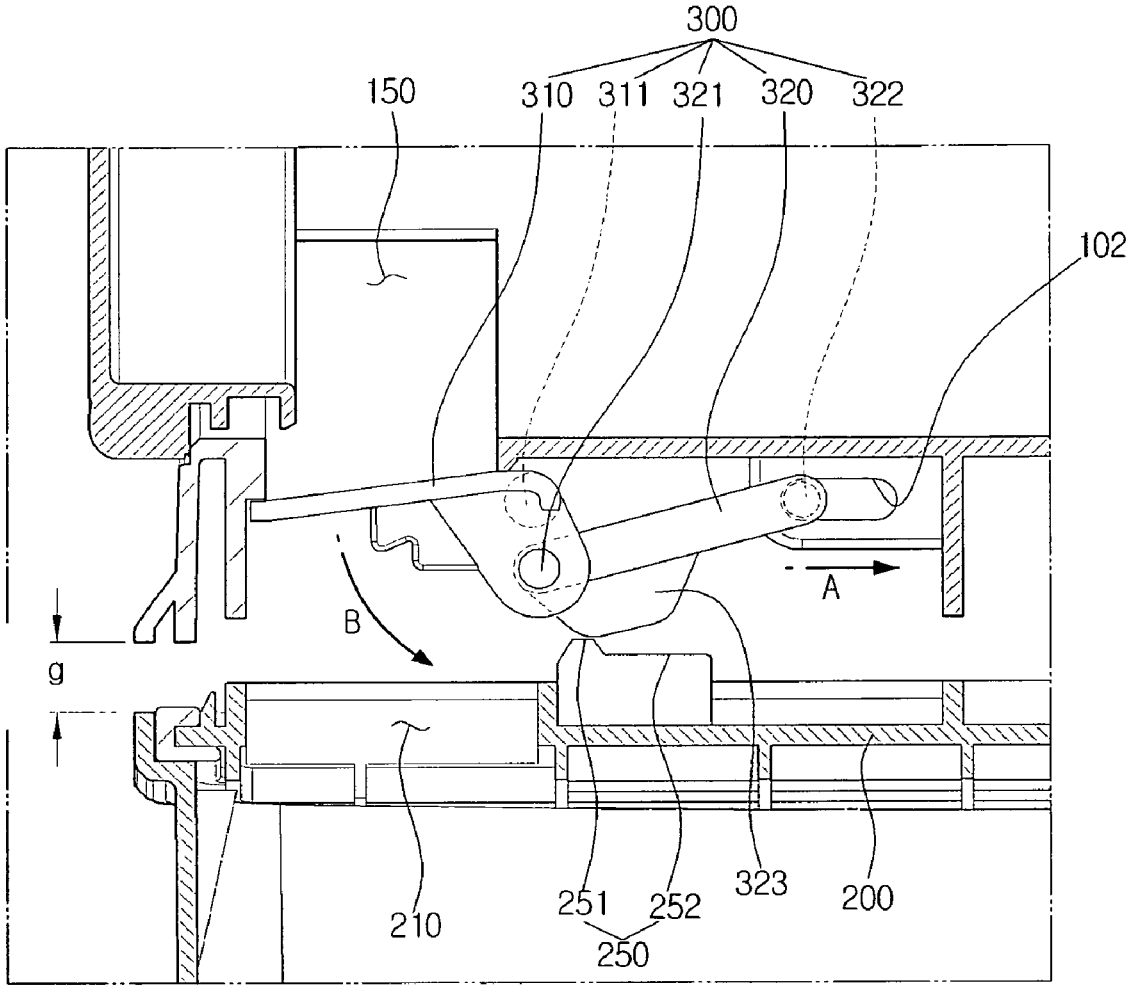
FIG. 5 is a sectional view illustrating a dust-separating apparatus and a dust receptacle prior to being mounted to the dust-separating apparatus.
Figure 6:
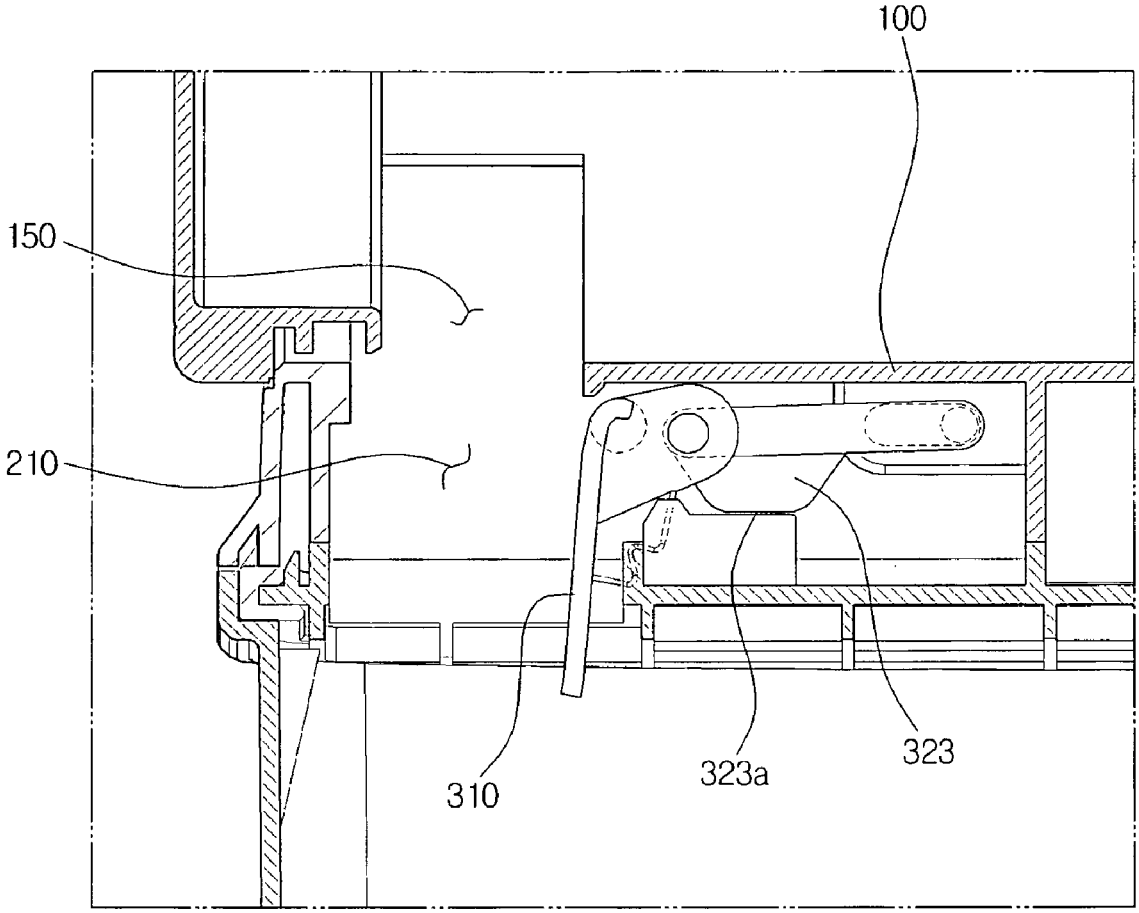
FIG. 6 a sectional view illustrating a dust-separating apparatus and a dust receptacle after being mounted on a cleaner body.

The shutter unit 300 includes a shutter plate 310, a link plate 320, and an elastic member 330 as shown in FIGS. 4 to 6.

The shutter plate 310 corresponds in size to the dust outlet 150, and is formed on the dust-separating apparatus 100 to rotatably open and shut about a first hinge 311.

The link plate 320 includes a second hinge 321, a third hinge 322, and an interference protrusion 323.

The second hinge 321 is formed on one end of the link plate 320, and rotatably connects the shutter plate 310 with the link plate 320.

The third hinge 322 fixes the link plate 320 to the dust-separating apparatus 100, and is slidably connected to the dust-separating apparatus 100 along with a sliding slot 102 which is formed horizontally on a lower surface of the dust-separating apparatus 100.

The interference protrusion 323 projects from a lower surface of the link plate 320. The position of the interference protrusion 323 may correspond to that of the blocking part 250 formed on the dust receptacle 200. If the interference protrusion 323 contacts the blocking part 250, the interference protrusion 323 causes the position of the link plate 320 to change.

The blocking part 250 includes a push protrusion 251 and a supporting surface 252. The push protrusion 251 presses the protrusion 323 upwards when the dust receptacle 200 is raised and mounted on the dust-separating apparatus 100, and the supporting surface 252 fixes the link plate 320 on the portion of the dust-separating apparatus 100 whereon the dust receptacle 200 is mounted.

The process of mounting the dust receptacle 200 of the vacuum cleaner will be explained with reference to FIGS. 5 and 6.

The dust receptacle 200 is detachably attached below the dust-separating apparatus 100. When a user attaches the dust receptacle 200 to the dust-separating apparatus 100, the dust receptacle 200 is inserted in a specific portion of the cleaner body 1. The dust-separating apparatus 100 is disposed opposite to the dust receptacle 200 separated apart from the dust receptacle 200 at a predetermined distance g.

While the dust-separating apparatus 100 is detached from the dust receptacle 200, the shutter unit 300 closes the dust outlet 150 of the dust-separating apparatus 100. Specifically, the shutter plate 310, which corresponds in size to the dust outlet 150, is placed to cause the elastic recovery of the elastic member 330 (referring to FIG. 4) to close the dust outlet 150. Even if the dust separated from air remains in the dust-separating apparatus 100, the remaining dust is not scattered or leaked out when the dust receptacle 200 is detached from the dust-separating apparatus 100, as the shutter plate 310 closes the dust outlet 150.

If the user raises the dust receptacle 200 on the specific portion to attach the dust receptacle 200 to the dust-separating apparatus 100, the blocking part 250 formed on the dust receptacle 200 contacts the protrusion 323 formed on the lower surface of the link plate 320, and thus the shutter unit 300 opens. Specifically, if the push protrusion 251 pushes the interference protrusion 323, the link plate 320 rises along with the dust receptacle 200, and thus the position of the link plate 320 is changed. If the link plate 320 moves upward, the third hinge 322 moves along with the sliding slot 102, so the link plate 320 moves as indicated by arrow A shown in FIG. 5.

The shutter plate 310 is rotatably connected to the dust-separating apparatus 100 by the first hinge 311. As the second hinge 321 connects the shutter plate 310 to the link plate 320, if the link plate 320 moves as indicated by arrow A in FIG. 5, the shutter plate 310 rotates in the direction indicated by arrow B, and opens the dust outlet 150.

If the dust-separating apparatus 100 and the dust receptacle 200 are completely closed by the raising of the dust receptacle 200, the supporting surface 252 of the blocking part 250 contacts a contact surface 323*a* of the interference protrusion 323 as shown in FIG. 6, and thus the link plate 320 is restrained from moving. Accordingly, the shutter plate 310 is kept open.

The elastic member 330 of a torsion spring (shown in FIG. 4) is formed on the second hinge 321 between the shutter plate 310 and the link plate 320. Accordingly, if the dust receptacle 200 is detached from the dust-separating apparatus 100, and if the pressure is released from the interference protrusion 323, the shutter plate 310 descends to its original position, thereby closing the dust outlet 150.

If the user detaches only the dust receptacle 200 without performing an operation to prevent dust from leaking out into the dust-separating apparatus 100, the shutter unit 300 operates in the reverse processes of those described above, and the dust outlet 150 automatically closes. Accordingly, the user can detach the dust receptacle 200 conveniently and clearly.

As the dust inlet 210 of the detached dust receptacle 200 is selectively shut by the sliding shutter 220, the dust is prevented from being scattered or leaked out when the user carries the dust receptacle 200.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A vacuum cleaner comprising:

a cleaner body;

a dust-separating apparatus to be fixed to the cleaner body, the dust-separating apparatus having a dust outlet;

a shutter unit formed on the dust-separating apparatus to selectively open and close the dust outlet; and a dust receptacle to be detachably attached to a lower portion of the dust-separating apparatus, wherein the dust receptacle opens the shutter unit when the dust receptacle is attached to the dust-separating apparatus, and closes the shutter unit when the dust receptacle is detached from the dust-separating apparatus, and wherein the shutter unit comprises:

a shutter plate to open the dust outlet, a link plate having one end hinged with the shutter plate and an opposite end slidably connected to a sliding slot formed on a lower surface of the dust-separating apparatus;

a blocking part on an upper side of the dust receptacle, the blocking part pushing on the link plate to open the shutter plate by rotating the link plate when the dust receptacle is attached to the dust-separating apparatus; and an elastic member to elastically support the link plate, and to close the shutter plate by rotating the link plate when the dust receptacle is detached from the dust-separating apparatus such that the blocking part does not push on the link plate.

2. The vacuum cleaner of claim 1, wherein the link plate comprises:

an interference protrusion disposed opposite the blocking part on the lower surface of the dust receptacle.

3. The vacuum cleaner of claim 2, wherein the blocking part comprises:

a push protrusion protruding from a portion of the dust receptacle opposite the interference protrusion; and a supporting surface to support the interference protrusion to restrict the link plate from rotating.

4. The vacuum cleaner of claim 3, wherein the receptacle comprises:

a dust inlet to correspond to the dust outlet; and a sliding shutter to selectively close the dust inlet.

5. The vacuum cleaner of claim 4, wherein the blocking part is formed on the sliding shutter.

6. The vacuum cleaner of claim 5, wherein the dust-separating apparatus is disposed to generate a whirling air current that rotates about a horizontal axis.

7. The vacuum cleaner of claim 6, further comprising an air inlet formed on one end of the dust-separating apparatus, the dust outlet being formed on a bottom surface of an opposite end of the dust-separating apparatus.

8. A vacuum cleaner comprising:

a dust-separating apparatus having a dust outlet;

a shutter unit at the dust outlet, the shutter unit being biased to normally close the dust outlet;

a dust receptacle having a dust inlet, the dust receptacle being detachably attached to the dust-separating apparatus so that the dust outlet communicates with the dust inlet; and a sliding shutter at the dust inlet to selectively close the dust inlet, wherein the dust receptacle opens the shutter unit when the dust receptacle is attached to the dust-separating apparatus, and closes the shutter unit when the dust receptacle is not attached to the dust-separating apparatus, and wherein the shutter unit comprises:

a shutter plate being biased to normally close the dust outlet;

a link plate having one end hinged with the shutter plate and an opposite end slidably connected to a sliding slot formed on a lower surface of the dust-separating apparatus;

a blocking part on an upper side of the dust receptacle to push the link plate to open the shutter plate by rotating the link plate when the dust receptacle is attached to the dust-separating apparatus; and an elastic member to elastically support the link plate, and to normally close the shutter plate by rotating the link plate when the dust receptacle is detached from the dust-separating apparatus such that the blocking part does not push on the link plate.

9. The vacuum cleaner of claim 8, wherein the link plate comprises an interference protrusion disposed opposite the blocking part on the lower surface of the dust receptacle.

10. The vacuum cleaner of claim 9, wherein the blocking part comprises:

a push protrusion protruding from a portion of the dust receptacle opposite the interference protrusion; and a supporting surface to support the interference protrusion to restrict the link plate from rotating.

11. The vacuum cleaner of claim 10, wherein the blocking part is formed on the sliding shutter.

* * * * *